United States Patent [19]

Dobatkin et al.

[11] Patent Number: 4,564,059

[45] Date of Patent: Jan. 14, 1986

[54] METHOD FOR CONTINUOUS CASTING OF LIGHT-ALLOY INGOTS

[76] Inventors: Vladimir I. Dobatkin, Rezervny proezd, 8, kv. 252; Georgy I. Eskin, ulitsa Vavilova, 48, kv. 281; Stella I. Borovikova, Vinnitskaya ulitsa, 13, kv. 140; Robert R. Malinovsky, Leningradsky prospekt, 75, kv. 448, all of Moscow; Viktor K. Junyshev, Verkhnaya Salda, ulitsa K. Marxa, 11, kv. 41; Alexandr I. Matveev, Verkhnaya Salda, ulitsa K. Libknekhta, 12, kv. 34, both of Sverdlovskaya oblast; Gennady S. Makarov, ulitsa Matveevskaya, 10, korpus 2, kv. 64, Moscow; Viktor A. Danilkin, ulitsa Bobruiskaya, 16, kv. 18, Moscow; Andrei D. Andreev, ulitsa Bobruiskaya, 20, kv. 69, Moscow; Boris I. Bondarev, Mozhaiskoe shosse, 80, kv. 113, Moscow; Petr N. Shvetsov, Barvikhinskaya ulitsa, 8, korpus 2, kv. 51, Moscow; Pavel E. Khodakov, Skolkovskoe shosse, 16, kv. 51, Moscow; Gennady V. Cherepok, prospekt Metallurgov, 73, kv. 54, Kuibyshev; Vladimir M. Baranchikov, ulitsa Isetskaya, 6, kv. 16, Kamensk-Uralsky, all of U.S.S.R.; Petr N. Silaeva, deceased, late of Sverdlovskaya oblast, U.S.S.R.; by Anna A. Silaeva, administrator, Verkhnaya Salda, ulitsa K. Libknekhta, 8, kv. 3, Sverdlovskaya oblast, U.S.S.R.

[21] Appl. No.: 565,140

[22] Filed: Dec. 23, 1983

Related U.S. Application Data

[63] Continuation-in-part of Ser. No. 273,655, Jun. 13, 1981, abandoned.

[51] Int. Cl.[4] ..... B22D 27/02

[52] U.S. Cl. ..... 164/478; 164/501; 164/71.1

[58] Field of Search ..... 164/501, 511, 260, 416, 164/478, 71.1

[56] References Cited

FOREIGN PATENT DOCUMENTS 47-24338 7/1972 Japan ..... 164/478

353790 11/1972 U.S.S.R. ..... 164/478

*Primary Examiner*—Kuang Y. Lin

*Attorney, Agent, or Firm*—McAulay, Fields, Fisher, Goldstein & Nissen

[57] ABSTRACT

A method for continuous casting of light-alloy ingots, consisting in pouring a melt, acting upon the melt with ultrasound using at least one radiator to purify the melt and to refine the structure of the solidifying ingot, the radiation being applied uniformly throughout the cross-section of the melt in an intensity of 2 to 60 W/cm$^2$ depending on the cross-sectional area of the solidifying ingot, the radiator being immersed into the melt to a depth equal to between 1/12 and $\frac{1}{4}$ of the sound wavelength in the material of the melt and the melt temperature being maintained by 60° to 150° C. above the liquidus temperature of the melt, and subsequently withdrawing the ingot.

19 Claims, 3 Drawing Figures

METHOD FOR CONTINUOUS CASTING OF LIGHT-ALLOY INGOTS

This application is a continuation-in-part of application Ser. No. 273,655 filed on June 13, 1981, now abandoned.

FIELD OF THE INVENTION

The present invention relates to metallurgy, and more particularly, to methods for continuous casting of light alloys.

The present invention can be employed in casting of light alloys used in the manufacture of deformable semi-finished products such as plates, forgings, various rolled sections and other products.

BACKGROUND OF THE INVENTION

In the manufacture of light alloys, characteristic of which is a high chemical activity in molten state, much consideration is given to the removal of nonmetallic impurities from the melt. The requirements upon the purity of metals and alloys in terms of hydrogen content, especially of solid nonmetallic oxide inclusions are growing ever more stringent. For example, no oxide inclusions larger than 10 μm are admissible in a number of aluminium alloy items such as foil for capacitors.

On the other hand making ingots from high-strength light alloys of medium and large size of section (e.g. up to 120 cm in diameter or with a cross-sectional size of up to 40×120 cm and greater) is characterized by a coarse-grained feathery structure, increased hydrogen content and porosity even in casting a vacuum-treated metal.

The way in which the structure of large ingots is formed and the resulting porosity lower the plasticity of the ingots and increase the tendency of the ingots to crack on casting, this restricting the dimensions of sound ingots which can be cast and decreasing alloy plasticity in subsequent press-working.

These aspects of the light alloy continuous casting underlie a wide industrial use of ultrasonic treatment of melt for effective purification of metal and refinment of the cast structure.

There is known a method for continuous casting of light-alloy ingots (cf. USSR Inventor's Certificate No. 353,790, Cl. B 60 B, 1972), comprising pouring a melt, acting upon the melt with at least one radiator for purifying the melt and refining the structure of a solidifying ingot and simultaneously withdrawing the ingot.

This method is put into effect at high rates of casting (for example, 30 cm/min), and the melt is treated with ultrasound for a short time, so that ingots of small cross-section may be cast. In application to casting ingots of medium and large cross-sections, this method is of a limited usefulness as the casting rate drops substantially (1 to 2 cm/min) and the ultrasonic treatment requires much time, all this leading to a substantial overheating of the melt so that the liquid portion of the solidifying ingot extends beyond the mould.

Another disadvantage of the known method is that structure refinement non-uniformity increases with the size of ingots.

Still another shortcoming of the known method is that the short time the ultrasound acts upon a poorly overheated melt proves to be unsufficiently effective as regards the removal of gaseous and solid nonmetallic impurities.

SUMMARY OF THE INVENTION

It is an object of the invention to provide a method for continuous casting of light-alloy ingots which would enhance the plasticity of light alloys in casting and during their subsequent deformation.

The above and other objects are attained in a method for continuous casting of light-weight alloy ingots, comprising pouring a melt, acting with ultrasound upon the melt by means of at least one radiator for purifying the melt and for refining the structure of the solidifying ingot and simultaneously withdrawing the ingot, wherein, according to the invention, the ultrasonic action upon the melt with a view to purifying the melt and refining the structure of the solidifying ingots is effected uniformly throughout the cross-section of the melt at an intensity ranging between 2 and 60 W/cm$^2$ depending on the cross-sectional area of the solidifying ingot, the radiator being immersed into the melt to a depth equal to between 1/12 and $\frac{1}{4}$ of the sound wavelength in the material of the melt, and the melt temperature being maintained by 60° to 150° C. above the liquidus temperature of the melt material.

The melt is preferably purified by causing it to pass through a porous material, the distance from the radiator to the porous material being maintained equal to between 1/12 and $\frac{1}{4}$ of the sound wavelength in the melt material.

The present invention reduces by a factor of 2 the amount of solid nonmetallic inclusions and by a factor of 2 to 3 the hydrogen content in the ingot material thus enhancing the plasticity of light-alloy ingots in the course of casting and during the subsequent deformation thereof.

The present invention also provides for an extra-refined type of structure in the light-alloy ingot, with the size of the cast grain being equal to, or smaller than, that of a dendritic cell, this also improving the plasticity of the light-alloy ingot in the course of casting and during the subsequent deformation thereof.

BRIEF DESCRIPTION OF THE DRAWINGS

These and other objects and features of the invention will become readily apparent from embodiments thereof which will be described by way of example with reference to the accompanying drawings, in which.

DESCRIPTION OF THE PREFERRED EMBODIMENT

A method for continuous casting of light-alloy ingots consists of pouring a melt, acting upon the melt with ultrasound using at least one radiator with a view to purifying the melt and refining the structure of the solidifying ingot in a uniform manner throughout the cross-section of the melt at an intensity of 2 to 60 W/cm$^2$ depending on the cross-sectional area of the solidifying ingot, the radiator being immersed into the melt to a depth equal to between 1/12 and $\frac{1}{4}$ of the sound wavelength in the melt material, the melt temperature being maintained by 60° to 150° C. above the liquidus temperature of the melt material, and subsequently withdrawing the ingot.

According to the invention, the melt is purified by causing it to pass through a porous material, the distance from the radiator to the porous material being maintained equal to between 1/12 and $\frac{1}{4}$ of the sound wavelength in the melt material.

A method for continuous casting of light-alloy ingots, according to the invention, can be put into effect on any known apparatus incorporating an additional ultrasonic action upon the melt to purify it and refine the structure of the solidifying ingot.

Figure 1:
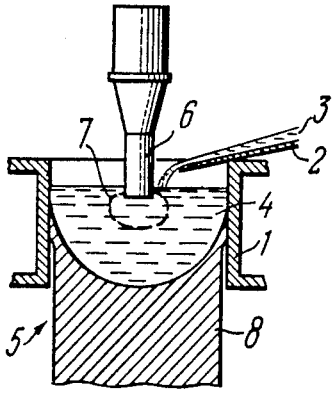
FIG. 1 is a cross-sectional front elevation of a widely known apparatus for continuous casting of light-alloy ingots for putting into effect a method according to the invention.

One of the known embodiments of an apparatus for continuous casting of light-alloy ingots comprises a mould 1 (FIG. 1) wherein a melt 3 is poured through a distributing trough 2. An ultrasonic radiator 6 is immersed into a liquid portion 4 of an ingot 5 to a depth equal to $\frac{1}{8}$ of the sound wavelength in the portion of the material of the melt 3. A cavitation zone 7 of the ingot (conventionally shown with a dotted line ) is formed at the immersed end of the radiator 6. The solidified portion 8 of the ingot 5 is withdrawn from the mould 1.

Figure 2:
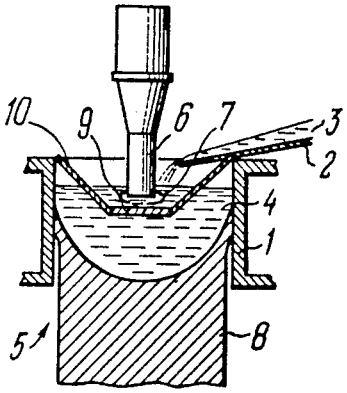
FIG. 2 is a cross-sectional front elevation of an apparatus for continuous casting of light-metal alloys, purified by causing them to pass through a porous material, according to the invention.
Figure 3:
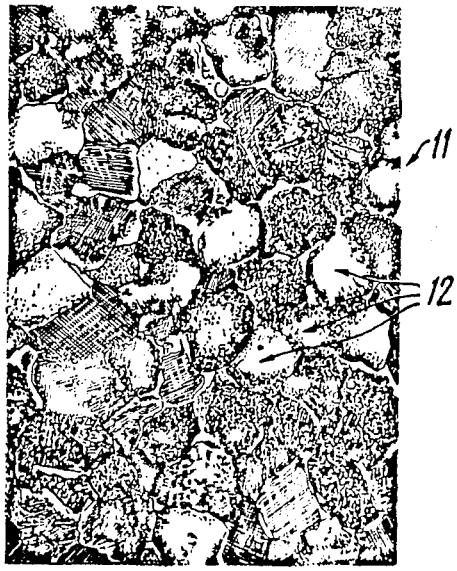
FIG. 3 is a view of a structure of a 65-cm dia ingot of an annealed light alloy of the Al-Cu-Mg-Zr type with sub-dendritic grain, according to the invention (10033 magnification).

FIG. 3 illustrates a structure 11 of the solidified portion 8 (FIGS. 1,2) of the 65-cm dia. ingot from an Al-Cu-Mg-Zr type alloy. The structure 11 (FIG. 3) consists of sub-dendritic grains 12 refined to as small a size as 0.01 cm across, which is equal to a dendritic cell (not shown in the figure).

A method according to the invention is put into effect in the known apparatus for continuous casting of light-alloy ingots as follows:

A zone of well-defined cavitation is known to form in the vicinity of the end of the radiator 6 immersed in the melt 3 (FIG. 1) upon reaching the threshold power of ultrasonic oscillations transmitted to the melt. Losses of the acoustic power in the crater of the ingot 5, including the cavitation losses, result in a melt temperature increase with the crater space by 10°–25° C.

The melt temperature increase in the crater, hence an increase in the temperature gradient, rules out the possibility of bulk solidification thus bringing about a substantial narrowing of the area of germination and growth of crystals, this area becoming closer to the solidification front.

The ultrasonic action upon the melt 3, which removes the capillary limitations, results in wetting non-controlled nonmetallic impurities thus increasing the number of activated particles.

The transfer of the activated particles with the mass of the incoming melt 3, together with acoustic flows directed toward the solidification front ensure the formation of a considerable number of solidification centers. The increase in the number of such solidification centers and the release of the solidification heat provide conditions for a low and uniform supercooling which results in the formation of a refined (sub-dendritic ) structure, i.e. the structure 11 (FIG. 3) consisting of equiaxial fine grains that do not have the dendritic structure.

Considering the relationship of the result of refinement of the structure 11 versus the power N of ultrasound introduced into the molten portion 4 of the ingot 5 it will be apparent that the ultrasonic power necessary for the preservation of the constant value of the ultrasound intensity and formation of the sub-dendritic structure increases with an increase in the diameter of the ingot 5. The ultrasound intensity determines the extent to which the cavitation phenomenon develops in the melt, i.e., it determines the formation of a cavitation zone 7 having a depth $h$ and a cross-sectional area $s$.

The studies showed that the refinement of the structure 11 depends on the average time $\tau$ of activation of impurities during which each batch of the melt 3 coming into the liquid portion 4 of the ingot 5 passes through the cavitation zone 7 where the non-controlled impurities are wetted. As the average time of activation of impurities is proportional to the ratio of the depth h of the cavitation zone 7 to the rate v of casting of the ingot 5, the following condition should be met to obtain the ingot 5 with the sub-dendritic structure 11:

$$\tau \approx \frac{h}{v}.$$

The value of h may be assessed based on the following considerations. Assuming the cross-sectional area S of the cavitation zone 7 is proportional to the cross-sectional area $S_1$ of the ingot 5, the volume W of the cavitation zone 7 is $W \approx S_1 \cdot h$.

It may also be assumed, on the other hand, that this volume W depends on the level of ultrasonic power N transmitted and is proportional thereto: $S_1 \cdot h \approx N$, i.e.

$$h \approx \frac{N}{S_1}.$$

The following formulae can be obtained for the residence time of each batch of the melt 3 in the cavitation zone 7:

$$\tau \approx \frac{h}{v} \approx \frac{N}{S_1 v} = \frac{N}{R},$$

wherein $R = S_1 \cdot V$ is the metal flow rate, i.e. the volume of metal passing through the cross-sectional area $S_1$ of the ingot 5 in a unit of time.

Therefore, in order to obtain the refined (sub-dendritic) structure 11, the condition $$\frac{N}{R} \approx \tau$$

should be fulfilled.

Hence $N \approx \tau R$, and this means that the ultrasonic power which enables the formation of the sub-dendritic structure is proportional to the metal flow rate.

Therefore, with an increase in the ingot diameter from 4.0 to 100 cm the volumetric intensity of the ultrasonic action which is determined by the N/R ratio changes within a relatively narrow range and is about 0.75 W min/cm$^3$.

As the volumetric intensity N/R remains practically unchanged with an increase in the diameter of the ingot 5, and the casting rate v decreases from 35 to 1 cm/min the intensity of ultrasound referred to the cross-sectional area $S_1$ of the ingot 5 also changes within a wide range:

| Ingot diameter, cm | Intensity of ultrasonic action, W/cm$^2$ |
|---|---|
| 4.0 | 60 |
| 6.5 | 30 |
| 17.0 | 4.4 |
| 27.0 | 2.4 |
| 65.0 | 2.11 |
| 84.5 | 2.0 |
| 98.0 | 2.0 |

At the same time, the intensity of the ultrasonic action upon the melt 3 seeping through the porous material 9 (FIG. 2) varies but slightly depending on the area of the material 9. It should also be borne in mind that the cross-sectional area of the material 9 is 2.5 to 3.0 times smaller than the cross-sectional area of the ingot 5.

The invention will be better understood from the following practical examples illustrating various embodiments thereof.

EXAMPLE 1

Ingots 5 of a light alloy of the Al-Zn-Mg-Cu-Zr type of the following composition (in % by weight: Zn-8.5; Mg-2.7; Cu-2.3; Zr-0.17; Ti-0.03; Fe-0.12; Si-0.08 were cast in a mould 1 (FIG. 1) 4.5 cm in dia., using the method according to the invention.

The structure of the ingots 5 produced under nine different conditions according to the invention given in Table 1 was then studied.

TABLE 1

| Test | Intensity of ultrasonic action (W/cm$^2$) | Radiator immersion depth, | Melt temperature, °C. | Casting rate, cm/min |
|---|---|---|---|---|
| I | | | 685 | |
| II | 60 | 1/12 | 710 | 35 |
| III | | | 775 | |
| IV | | | 685 | |
| V | 60 | ⅛ | 710 | 35.0 |
| VI | | | 775 | |
| VII | | | 685 | |
| VIII | 60 | ¼ | 710 | 35.0 |
| IX | | | 775 | |

The liquidus temperature was t=625° C.

It has been found that uniformly refined sub-dendritic grain of a size between 10 and 15 mm was formed in the ingots 5 under all conditions of ultrasonic action. The refinement of the grain was accompanied by the reduction in size of all structural components (second phases, thickness of eutectic releases at the grain boundaries) and by an increase in the density of the ingot 5. This changes in the structure of the ingot 5 resulted in a better ductility with the same level of strength characteristics (Table 2).

TABLE 2

| Mechanical ingot strength characteristics | Test temperature, °C. | Structure characteristic | |
|---|---|---|---|
| | | Sub-dendritic | Dendritic |
| Ultimate strength, $10^7$ Pa | 20 | 22.5 | 22.6 |
| | 400 | 3.7 | 3.5 |
| Relative elongation, % | 20 | 4.0 | 3.7 |
| | 400 | 132.5 | 98.2 |

EXAMPLE 2

In the mould 1 (FIG. 1) 28 cm in dia. ingots 5 of a light-alloy of the Al-Zn-Mg-Cu-Zr type of the following composition (in % by weight): Zn-8.5; g-2.5; Cu-2.32; Zr-0.17; Ti-0.02; Fe-022; Si-0.11 were cast using the method according to the invention (similarly in Example 1).

The structure and properties of the ingots 5 produced by the method according to the invention under nine different conditions given in Table 3 were studied.

TABLE 3

| Test | Intensity of ultrasonic action, W/cm$^2$ | Radiator immersion depth, | Melt temperature, °C. | Casting rate, cm/min |
|---|---|---|---|---|
| I | | | 685 | |
| II | 2.4 | 1/12 | 725 | 4.9 |
| III | | | 775 | |
| IV | | | 685 | |
| V | 2.4 | ⅛ | 725 | 4.9 |
| VI | | | 775 | |
| VII | | | 685 | |
| VIII | 2.4 | ¼ | 725 | 4.9 |
| IX | | | 775 | |

The liquidus temperature was t=625° C.

The study of the structure of the ingots 5 showed that under all tested conditions the formation of the uniform sub-dendritic structure 11 (FIG. 3) occurred over the cross-section and length (up to 600 cm) of the ingot 5, with the grain size being between 40 and 50 μm.

The refinment of structural components, lowering of hydrogen content and reduction of porosity resulted in improved plasticity properties with the same level of strength characteristics (Table 4).

TABLE 4

| Characteristics | Test temperature, °C. | Structure type | |
|---|---|---|---|
| | | Sub-dendritic | Dendritic |
| Ultimate strength, $10^7$ Pa | 20 | 19.4 | 18.1 |
| | 400 | 4.0 | 3.9 |
| Relative elongation, % | 20 | 2.8 | 1.0 |
| | 400 | 121.5 | 107.7 |

EXAMPLE 3

In the mould 1 (FIG. 1) 84.5 cm in dia. the ingots 5 of a light alloy of the Al-Zn-Mg-Cu-Zr type of the following composition (Table 5) were cast using the method according to the invention (similarly to Example 1):

TABLE 5

| Alloy | Content of components in % by weight | | | | | | | |
|---|---|---|---|---|---|---|---|---|
| | zinc | magnesium | copper | zirconium | titanium | manganese | iron | silicon |
| Composition I | 6.03 | 2.18 | 2.06 | 0.13 | 0.04 | 0.013 | 0.11 | 0.072 |
| Composition II | 6.06 | 2.47 | 1.73 | 0.15 | 0.04 | 0.015 | 0.10 | 0.038 |

The structure and properties of the ingots 5 produced under nine different conditions given in Table 6 were studies.

TABLE 6

| Test | Intensity of ultrasonic action, W/cm$^2$ | Radiator immersion depth, λ | Melt temperature, °C. | Casting rate, cm/min | Cracking |
|---|---|---|---|---|---|
| I | | | 685 | | None |

TABLE 6-continued

| Test | Intensity of ultrasonic action, W/cm² | Radiator immersion depth, λ | Melt temperature, °C. | Casting rate, cm/min | Cracking |
|---|---|---|---|---|---|
| II | 2.0 | 1/12 | 725 | 1.45 | None |
| III | | | 775 | | None |
| IV | | | 685 | | None |
| V | 2.0 | ⅛ | 725 | 1.45 | None |
| VI | | | 775 | | None |
| VII | | | 685 | | None |
| VIII | 2.0 | ¼ | 725 | 1.45 | None |
| IX | | | 775 | | None |

The liquidus temperature was t=625° C.

The employment of the ultrasonic action of an intensity of about 2 W/cm² ensured the hundred-persent manufacture of large-size ingots 84.5 cm in dia. without cracks.

EXAMPLE 4

Ultrasonic action was used to purify the melt 3 (FIG. 2) of a light alloy of the Al-Cu-Mg type in casting 20.4 cm dia. ingots 5. The ultrasonic action upon the melt 3 was effected at the frequency of 18 kHz and at 740° C., i.e. by 100° C. above the liquidus temperature of the melt 3, uniformly throughout the cross-section thereof at an intensity of 40 W/cm². Porous material 9 was composed of layers of a glassfiber cloth with a mesh of 0.6×0.6 mm. The distance from the porous material 9 to the radiator 6 was maintained equal to between 2.0 and 4.0 cm, i.e. between 1/12 and 1/6 of the sound wavelength in the melt 3.

Data on the purity of the material of the ingot 5 cast by the method according to the invention are given in Table 7.

TABLE 7

| | Number of layers in porous material | Content of nonmetallic impurities: hydrogen, cm³/100 g | Content of nonmetallic impurities: $Al_2O_3$, % by weight |
|---|---|---|---|
| Method according to the invention | 5 | 0.12 | 0.0066 |
| | 9 | 0.10 | 0.0040 |

Note. The content of $Al_2O_3$ in the material of the ingot 5 was determined by the bromine-methanol technique, and the hydrogen content, by the vacuum extraction technique.

According to the invention, the ultrasonic action through the porous material 9 in the form of a multilayer net filter reduces by a factor of 2 to 3 the content of hydrogen and oxides as compared to a known procedure.

The method according to the invention makes it possible to cast sound large-size ingots of high-strength light alloys of various types, having a tendency to form cracks, through an effective purification of the alloys and refinment of their structure.

We claim:

1. A method for continuous casting of a light-alloy ingot, comprising:

pouring a melt material into a continuous casting mold, applying an ultrasonic action to said melt by means of at least one radiator for purifying said melt and refining the structure of said ingot solidifying from said melt; said ultrasonic action being effected uniformly throughout the cross-section of said melt to form a cavitation zone, h, at an intensity of 2 to 60 W/cm² depending on the cross-sectional areas of said solidifying ingot, said radiator being immersed in said melt to a depth of 1/12 to ¼ of the sound wavelength in said melt material, the temperature of said melt material being maintained between 60 to 150° C. above the liquidus temperature of said melt material wherein $W \approx S_1 \cdot h$; and withdrawing ingot now having an extra refined structure.

2. A method according to claim 1, wherein said melt is purified by causing it to pass th rough a porous material, the distance from said radiator to said porous material being maintained equal to 1/12 to ¼ of the sound wavelength in said material of said melt.

3. The method of claim 1, wherein the size of the cast grain is equal to or less than that of a dendritic cell.

4. The method of claim 1, wherein the radiator is immersed to a depth of about ⅛ of the wavelength of sound in the melt.

5. The method of claim 2, wherein the distance between the radiator and the porous material is ⅛ of the wavelength of sound in the melt.

6. The method of claim 1, wherein the ingot is an alloy containing Al-Zn-Mg-Cu-Zr.

7. The method of claim 1, wherein the liquidus temperature is 625° C.

8. The method of claim 2, wherein said ingot consists of equiaxial grains.

9. The method of claim 2, wherein the radiator is immersed to a depth of about ⅛ of the wavelength of sound in the melt.

10. The method of claim 9, wherein the distance between the radiator and the porous material is about ⅛ of the wavelength of sound in the melt.

11. The method of claim 10, wherein the ingot is an Al-Cu-Mg alloy.

12. The method of claim 11, wherein said ultrasonic action is effected at a frequency of 18 kHz and at a temperature of 740° C.

13. The method of claim 6, wherein the size of the cast grain is equal to or less than that of a dendritic cell.

14. The method of claim 2, wherein the radiator is immersed to a depth of about ¼ of the wavelength.

15. The method of claim 2, wherein the distance between the radiator and the porous material is ¼ of the wavelength of sound in the melt.

16. The method of claim 8, wherein the ingot is an Al-Cu-Mg alloy.

17. A method for continuous casting of Al-Zn-Mg-Cu-Zr light-alloy ingots, comprising:

pouring a melt and passing the melt through a porous material while maintaining the distance between the radiator and the porous material between 1/12 to ¼ of the wavelength of the sound in the melt;

applying ultrasound upon said melt with at least one radiator in order to purify said melt and refine a structure of a solidifying ingot from said melt, the ultrasound providing ultrasonic action which is effected uniformly throughout the cross-section of said melt to form a cavitation zone, h at an intensity of 2 to 60 W/cm² as a function of the cross-sectional area, $S_1$, of said solidifying ingot, wherein $W \approx S_1 h$;

immersing the radiator into the melt to a depth of 1/12 to ¼ of the wavelength of the sound of said melt;

maintaining the temperature of the melt between 60 to 150° C. above the liquids temperature of the material of the melt; and withdrawing the ingot to produce a cast grain wherein the size of the cast grain is equal to or less than that of a dendritic cell.

18. The method of claim 17, wherein the radiator is immersed to a depth of about $\frac{1}{8}$ of the wavelength of sound in the melt.

19. The method of claim 17, wherein the melt is poured through a distributing trough.

* * * * *